US005346552A

United States Patent [19]

Zimmer

[11] Patent Number: 5,346,552

[45] Date of Patent: Sep. 13, 1994

[54] DEVICE HAVING A PROFILE STRIP EQUIPPED WITH A SQUEEZE ELEMENT THAT IS FREELY MOVABLE TRANSVERSELY TO A WORKING SURFACE

[76] Inventor: Johannes Zimmer, Ebentaler Str. 133, 9020 Klagenfurt, Fed. Rep. of Germany

[21] Appl. No.: 948,644

[22] Filed: Sep. 23, 1992

[30] Foreign Application Priority Data

Sep. 23, 1991 [DE] Fed. Rep. of Germany ... 9112033[U]

[51] Int. Cl.[5] ..... B05C 11/02

[52] U.S. Cl. ..... 118/126; 118/413

[58] Field of Search ..... 118/126, 213, 413, 414; 101/120

[56] References Cited

U.S. PATENT DOCUMENTS

| | | | |
|---|---|---|---|
| 3,886,861 | 6/1975 | Anselrode | 101/120 |
| 4,920,914 | 5/1990 | Zimmer | 101/120 |
| 4,993,352 | 2/1991 | Zimmer | 118/413 |

FOREIGN PATENT DOCUMENTS

| | | |
|---|---|---|
| 376399 | 11/1984 | Austria . |
| 392745 | 5/1991 | Austria . |
| 2207935 | 11/1972 | Fed. Rep. of Germany . |
| 3324950 | 1/1985 | Fed. Rep. of Germany . |
| 3639665 | 12/1987 | Fed. Rep. of Germany . |

*Primary Examiner*—Robert A. Dawson
*Assistant Examiner*—Sun Uk Kim
*Attorney, Agent, or Firm*—Fay, Sharpe, Beall, Fagan, Minnich & McKee

[57] ABSTRACT

A squeegee device includes a profile strip equipped with a squeegee element that is freely movable transversely to a working surface. Profile strip bearing points engage loosely on pivot bearing guide surfaces transversely to the working surface to fix the pivot axis position. The profile strip is freely rotatable or pivotable in the pivot bearing, at least one part of the profile strip projecting over the working surface while being fixed to the profile strip bearing part, which is located in the vicinity of the squeegee device pivot axis. The squeegee device can be pressed against the working surface by its own weight or by a magnetic force exerted by a magnet device positioned below the working surface.

22 Claims, 1 Drawing Sheet

DEVICE HAVING A PROFILE STRIP EQUIPPED WITH A SQUEEZE ELEMENT THAT IS FREELY MOVABLE TRANSVERSELY TO A WORKING SURFACE

BACKGROUND OF THE INVENTION

1. Field of the Invention

The invention relates to a squeegee means comprising a squeegee device which has a profile strip longitudinally extending therewith and which can be pressed by its squeegee working edge or face against a working substrate (working surface) such as a table, a roller and a material web resting thereon, a conveyor belt, a screen, etc., the squeegee device being pivotable by means of pivot bearings about a squeegee device pivot axis coinciding with the bearing edge or extending in the vicinity of the bearing edge or face, said pivot bearings being located in the axial end regions of the squeegee device pivot axis to fix the position thereof, and in which the profile strip is connected to a part which projects over the working surface in the direction of the profile strip longitudinal extension and is in engagement with a pivot bearing located outside and laterally of the working surface.

Such devices are more particularly used for applying substances to a working surface to be printed or coated. However, they are also used in order to treat a flat substrate such as a web, a flat material portion, a roller or a strip by a stripping or sealing process. By pivoting the squeegee device (especially during the squeegee process) and fixing the squeegee device pivot angle, it is possible to adjust the size of a desired substance space between the profile strip and the working surface upstream of the squeegee element or a desired engagement angle of the squeegee element on the working surface. There must only be a slight or no change to the squeegee bearing edge position, so that the unchanged squeegee device pivot axis position coincides precisely or virtually with the bearing edge.

2. Description of the Related Art

In a known squeegee means(DE-A-22 07 935) a squeegee device comprises a rod, whose two ends are fixed to linkage arms, which are fitted by forkheads in an articulated manner to a shaft. Said device, which as a result of the arrangement of a crank gear requires considerable constructional expenditure, is only suitable for a stripping blade located on the squeegee element. By fixed mounting on the joints, the squeegee element is set in a fixed spacing position relative to the working surface, so as to then press the stripping blade against the working surface accompanied by supporting against the fixed mounted squeegee element by means of an air chamber. For the same set inclination position of the squeegee element a substance gap is influenced in an uncontrolled manner by modifying the air chamber pressure. The rod of the squeegee device must be constructed as a force-actuatable support beam, so that the weight of the squeegee device or forces acting thereon are absorbed by means of the support beam rod and the bearings. Therefore the known squeegee device with the support beam rod must be made in a very robust manner and, due to the connections with the bearings, fitting, disassembly and cleaning are complicated.

DE-OS 2 209 630 discloses a squeegee device which is pivotable about pivot joints located in the extension of the squeegee bearing edge where, much as in the aforementioned device, a lever construction is required with which the squeegee device is fixedly mounted by means of a support element (support beam).

In addition, squeegee devices with a profile strip are known (EP-A1-311 728), which are connected by means of a pivot joint to a retaining element connected to a support beam. In the case of such a squeegee device, special measures are necessary for maintaining the position of the squeegee bearing edge and consequently the complete squeegee device is not very handy due to the pivot joint connected thereto, so that the handling remains unsatisfactory, particularly when installed in the confined space of rotary screens. Handling is particularly difficult if the squeegee device extends over several meters.

SUMMARY OF THE INVENTION

The problem of the present invention is to provide a squeegee means with a relatively lightweight, universally usable squeegee device, which even in the case of a long lengthwise extension can easily be inserted in or removed from a simply constructed squeegee means.

In connection with the features of the aforementioned squeegee means, according to the invention this problem is solved in that the profile strip is equipped with a random squeegee element such as a roller squeegee, coating squeegee or normal squeegee and the squeegee device is positioned loosely, i.e. freely movable via the squeegee element in a direction at right angles to the working surface resting on the latter. By means of profile strip bearing points engaged loosely on pivot bearing guide surfaces at right angles to the working surface for fixing the pivot, axis position the profile strip bearing parts is inserted so as to be freely rotatable or pivotable in the pivot bearings. At least one part of the profile strip projecting over the working surface is fixed to the profile strip bearing part, which is located in the vicinity of the squeegee device pivot axis and is preferably circular or circular cylindrical. Without positive or non-positive fixing to the squeegee means, the squeegee device can be pressed against the working surface only with the magnetic force of a magnet device positioned below the working surface and/or with the weight of the squeegee device. For controlling the fixed setting of a squeegee device pivot angle, a portion of the profile strip or a part fixed thereto has a radial spacing (r1, r2) with respect to the squeegee device pivot axis, and is in loose (fastener-free) engagement with a control part movable and fixable transversely to the squeegee extension. A radial spacing (r1) is approximately 30 to 150 cm.

The squeegee device of the squeegee means according to the invention has a particularly light weight, because there is no need for a support beam carrying the squeegee device. A relatively small and inexpensive squeegee device is obtained, which is a rigid, compact and easily handlable component. Thus, the parts of the squeegee device are interconnected rigidly, i.e. without joints between the parts. It is also very advantageous that the squeegee means has a space-saving construction and the squeegee device can be easily inserted in or removed from the squeegee means. The construction of the squeegee device makes it possible to equip the latter in random manner with random squeegee elements. Despite the simple construction and handling of the squeegee means or device, it is ensured that the device, particularly in the operating state, can be pivoted about a pivot axis fixed in the position coinciding with the bearing edge or located roughly in the vicinity of the bearing edge or face and can be fixedly adjusted in the pivoting position.

According to a particularly advantageous development of the invention, the extension part of the profile strip projecting over the working surface is rigidly connected with a radial spacing to the squeegee device pivot axis with a single linkage ann located outside the working surface area and pivotable about the squeegee device pivot axis. Said arm is rigidly connected to a bearing part, preferably a circular cylindrical element, which engages in loose, rotary and slidable manner between the pivot bearing guide faces of a guide recess.

For the pivoting control and fixing of a desired squeegee device pivoting position, a control part can engage directly on the profile strip or a squeegee device part connected thereto. If desired, the control part can also be installed above or below the working surface.

With respect to a squeegee means according to the invention having a magnetic pressing action, it is particularly advantageous for the pivot bearings having the guide faces to be freely displaceably mounted independently of one another in a direction transverse to the squeegee extension and parallel to the working surface, the control part determining and fixing the pivoting angle position, together with the associated pivot bearing, being mounted in a freely displaceable manner on a bearing part of the squeegee means. Thus, the squeegee device is pivotable about a space axis at right angles or perpendicular to the working surface in such a way that the magnetically pressed squeegee element with its bearing edge comes to rest in precisely aligned manner with the magnet beam of a magnet device positioned below the working surface, i.e. is automatically oriented in optimum manner in the magnetic field of the magnet device.

BRIEF DESCRIPTION OF THE DRAWING

Further developments of the invention are set forth in the following detailed description. Particular advantages and embodiments of the invention are described in greater detail hereinafter relative to the drawings, wherein show.

DETAILED DESCRIPTION OF THE PREFERRED EMBODIMENTS

Figure 2:
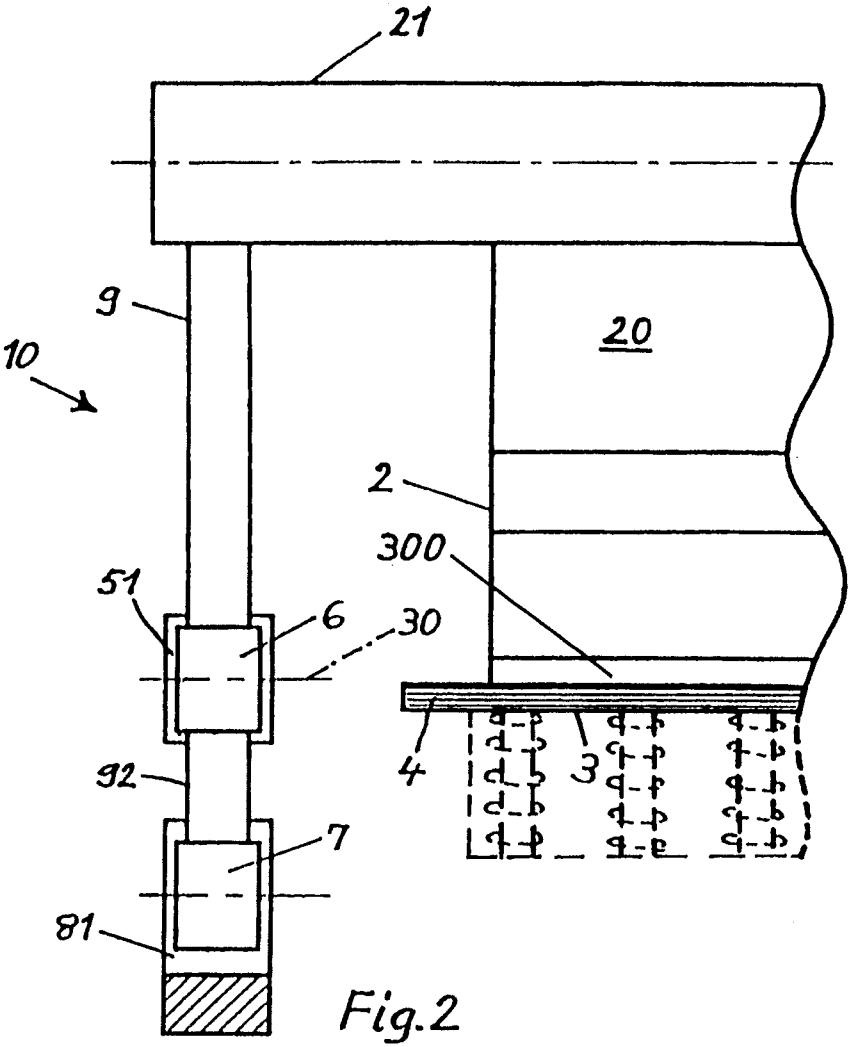
FIG. 2 In longitudinal view an inventive squeegee means corresponding to an embodiment according to FIG. 1.
Figure 1:
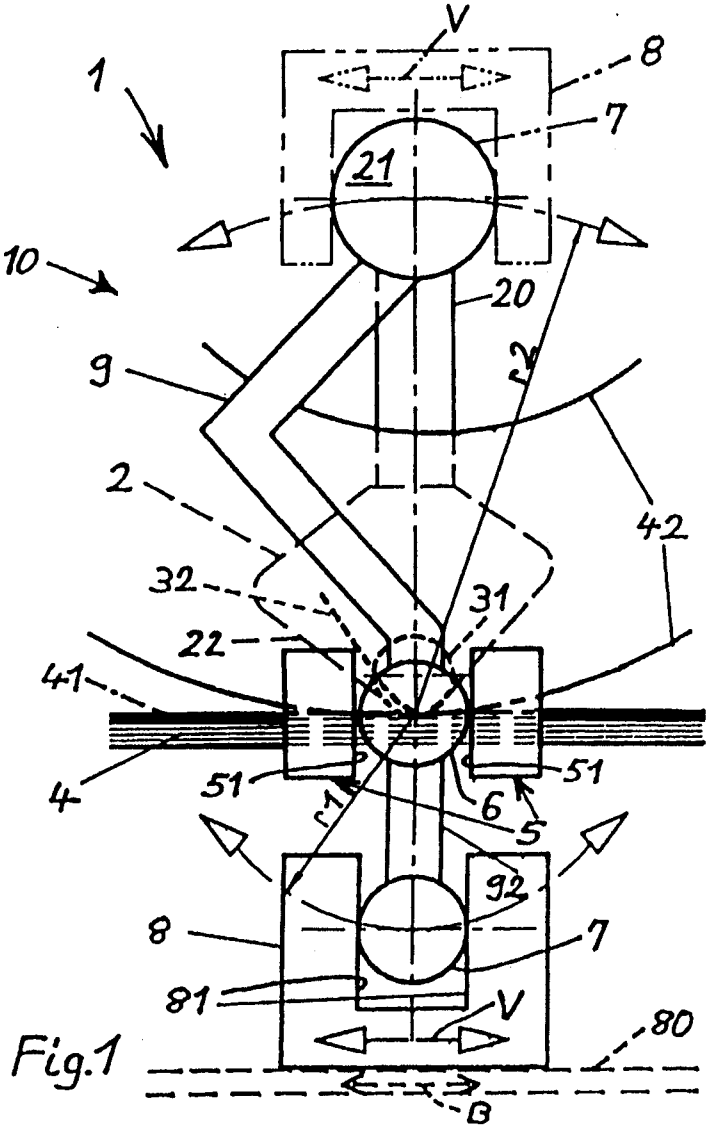
FIG. 1 In transverse view an embodiment of an inventive squeegee means.

FIGS. 1 and 2 show a squeegee means 1 according to the invention, and which comprises the following rigidly interconnected parts. A profile strip 2 is provided with a spacing strip 20 arranged above the same. To the top side of the spacing strip 20 is fixed an extension part 21, which projects over the working surface in the direction of the longitudinal extension of the profile strip 2. A linkage arm is connected in non-rotary manner to the outer end of the part 21. The linkage arm 9 extends outside the working surface to the frontal side of the squeegee means in the vicinity of a squeegee working edge or face 3 and from there with an am element 92 into an area laterally and below the working surface 4. In the vicinity of the squeegee working edge/face 3 on the linkage arm 9 is located in rotation-proof manner a circular cylindrical element 6, whose cylinder axis forms the pivot axis 30 of the squeegee device 10, said axis 30 being precisely or approximately aligned with the squeegee working edge 3, i.e. comes to rest therein. A circular cylindrical element 7 is located on the lower free end of the linkage arm 9. This element 7, whose cylinder axis extends parallel to the pivot axis 30, can be non-rotary, but also connected in the form of a roll to the linkage arm 9.

The above-described squeegee device 10 is mounted by means of a squeegee element 300 on the working surface 4, so that by means of the squeegee element 300 it rests on the working surface 4 freely tiltable about its working edge. The squeegee device 10 is only positioned by a guide bearing in the form of pivot bearing 5 and is freely rotatable about the pivot axis 30, which is fixed in position, by freely resting on the working surface 4.

The bearing 5 forms a guide receptacle for the rotation element 6. This receptacle is only provided with guide faces 51, which extend at right angles to the working surface 4 and parallel to the cylinder axis of the element 6. The rotation element 6 with its cylinder face engages loosely and in freely rotatable manner between and on the guide faces 51. In this way the pivot axis aligned with the squeegee working edge 3 is fixed in position. The element 6 is freely displaceable in directions perpendicular to the working surface 4, so that the squeegee device 10 can be easily removed upwards out of the squeegee means 1 or conversely inserted therein.

The cylinder element 7 engages an upwardly open, U-shaped control part 8. Between the legs of the control part 8 the cylinder element 7 is loosely freely rotatable, i.e. under linear engagement of its cylinder face on the leg faces 81 and is freely displaceably guided at right angles to the working surface 4. The control part 8 is connected to the frame of a squeegee machine and is displaceably movable (by means of an electric motor, for example) and fixable in the direction of the double arrow V. The sliding of the control part 8 pivots the squeegee device 10 about the pivot axis 30, the cylinder element 7 moving on the circle with the radius r1 and the extension part 21 on a circle with the radius r2 about the pivot axis 30. The control part 8 is fixed in a desired sliding position, so that as a result a desired pivoting position of the squeegee device 10 is set. Therefore the profile strip 2 with its profile face 22 or a squeegee element 300 is brought into a desired pivoting position about the pivot axis 30. The profile strip 2 can e.g. be equipped with a roller squeegee 31 or a coating squeegee 32, as indicated in broken line form in FIG. 1.

FIG. 1 shows a screen 42, by which a substance is applied to the working surface 4 or a material web 41.

As can be seen in FIG. 1, the control part 8 can also be positioned above the working surface 4. Such a control part 8 is only shown in broken line form. Its U-legs loosely engage around a cylinder element 7 arranged on the extension part 21. FIGS. 1 and 2 show an inventive squeegee means in the vicinity of a front end of the squeegee device 10. It is obvious that the squeegee means 1 is correspondingly constructed in the vicinity of the other end of the squeegee device 10 and it is advantageous that there is no need there for the control arm 92 with the control part 8. It is particularly pointed out that the part 21 projecting over the profile strip 2 and also the linkage arm 9 are only provided for positioning the pivot axis 30, so that these parts do not transmit forces supporting the weight of the squeegee device or serving for squeegee pressing purposes and are consequently constructed in a particularly lightweight manner.

Preferably the squeegee device 10 of a squeegee means 1 according to the invention can be pressed by the magnetic force of a magnet device positioned below the working surface (not shown in the drawing) and at least parts of the squeegee device or the profile strip or optionally the squeegee elements are magnetizable. However, it may be adequate for certain applications for the pressing action to take place solely through the weight of the squeegee device.

In the case of magnetic pressing, a particularly advantageous embodiment of the invention comprises the pivot/guide bearing 5 and a base plate 80 of the control part 8 being fixed to one another and freely displaceable in directions B transverse to the squeegee extension. Correspondingly there is a guide bearing 5 on the opposite face of the squeegee means, where it is fixed to a freely displaceably mounted base plate. Therefore the squeegee device 10 is freely pivotable about a space axis perpendicular to the squeegee device longitudinal axis, so that the squeegee working edge 3 and the pivot axis 30 aligned therewith come to rest through the action of the magnetic force in an optimum, automatic manner in the magnetic field of the magnet device. The control part 8 can be in any desired sliding position fixed on the base plate 80.

I claim:

1. Squeegee means (1) comprising a squeegee device (10), which has a profile strip (2) longitudinally extending therewith and which can be pressed by its squeegee working edge or face (3) against a working surface (4), the squeegee device (10) being pivotable by means of pivot bearings about a squeegee device pivot axis (30) coinciding with the squeegee working edge (3) or extending in the vicinity of a bearing edge or face, said pivot bearings (5) being located in the axial end regions of the squeegee device pivot axis (30) and fix the position thereof and in which the profile strip (2) is connected to a part (21), which projects over the working surface (4) in the direction of the profile strip longitudinal extension and is in engagement with a pivot bearing (5) located outside and laterally of the working surface (4), wherein the profile strip (2) is equipped with a squeegee element, and the squeegee device (10) is positioned loosely, i.e. freely movable via the squeegee element (300) in a direction at right angles to the working surface (4) resting on the latter, and a profile strip bearing part (6) engages loosely on pivot bearing guide surfaces (51) at right angles to the working surface (4) for fixing the pivot axis position and is inserted so as to be freely rotatable or pivotable in the pivot bearings (5) and at least one part (21) of the profile strip (2) projecting over the working surface (4) is fixed to the profile strip bearing part (6), which is located in the vicinity of the squeegee device pivot axis (30) and is circular or circular cylindrical; and without positive or non-positive fixing to the squeegee means (1), the squeegee device (10) can be pressed against the working surface (4) only with the magnetic force of a magnet device positioned below the working surface and/or with the weight of the squeegee device; and for controlling and the fixed setting of a squeegee device pivot angle, a portion of the profile strip or a part (7) is fixed to the squeegee device (10) and has a radial spacing (r) to the squeegee device pivot axis (30) and is in loose (fastening-free) engagement with a control part (8) movable and fixable transversely to the profile strip longitudinal extension.

2. Squeegee means according to claim 1, wherein the extension part (21) of the profile strip (2) projecting over the working surface (4), in a radial spacing (r2) to the squeegee device pivot axis (30), is rigidly connected to the linkage arm (9) pivotable about the same and positioned outside and laterally of the working surface and to which is fixed the bearing part (6) in loose engagement with the pivot bearing guide faces (51).

3. Squeegee means according to claim 2, wherein the control part (8) and the part (7) in loose engagement therewith and located on a linkage arm (9) rigidly connected to the profile strip form a link motion with a round element (7) and a flat, fork-like element (8) loosely engaging thereon.

4. Squeegee means according to claim 2, wherein the bearing parts (6) in loose engagement with the pivot bearing guide faces (51) and the part (7) in loose engagement with the control part (8) are located with a radial spacing (r1), which is approximately 30 to 150 cm.

5. Squeegee means according to claim 2, wherein the control part (8) and the part (7) in loose engagement therewith are positioned laterally and above the working surface (4).

6. Squeegee means according to claim 2, wherein the squeegee device (10) can be pressed by means of a magnet device positioned below the working surface (4) against the latter and that pivot bearings (5) located laterally and outside the working surface (4) and having the guide faces (51) independently of one another are freely displaceably mounted in a direction a right angles to a squeegee direction and parallel to the working surface (4), the control part (8) determining and fixing the pivoting angle position and an associated pivot bearing (5) are jointly freely displaceably mounted with a bearing part (6).

7. Squeegee means according to claim 2, wherein the control part (8) is displaceably movable relative to the pivot bearing (5) in directions (V) transverse to a squeegee extension.

8. Squeegee means according to claim 1, wherein the control part (8) and the part (7) in loose engagement therewith and located on a linkage arm (9) rigidly connected to the profile strip form a link motion with a round element (7) and a flat, fork-like element (8) loosely engaging thereon.

9. Squeegee means according to claim 8, wherein the bearing parts (6) in loose engagement with the pivot bearing guide faces (51) and the part (7) in loose engagement with the control part (8) are located with a radial spacing (r1), which is approximately 30 to 150 cm.

10. Squeegee means according to claim 8, wherein the control part (8) and the part (7) in loose engagement therewith are positioned laterally and above the working surface (4).

11. Squeegee means according to claim 8, wherein the squeegee device (10) can be pressed by means of a magnet device positioned below the working surface (4) against the latter and that pivot bearings (5) located laterally and outside the working surface (4) and having the guide faces (51) independently of one another are freely displaceably mounted in a direction a right angles to a squeegee direction and parallel to the working surface (4), the control part (8) determining and fixing the pivoting angle position and an associated pivot bearing (5) are jointly freely displaceably mounted with a bearing part (6).

12. Squeegee means according to claim 8, wherein the control part (8) is displaceably movable relative to the pivot bearing (5) in directions (V) transverse to a squeegee extension.

13. Squeegee means according to claim 1, wherein the bearing parts (6) in loose engagement with the pivot bearing guide faces (51) and the part (7) in loose engagement with the control part (8) are located with a radial spacing (r1), which is approximately 30 to 150 cm.

14. Squeegee means according to claim 13, wherein the control part (8) and the part (7) in loose engagement therewith are positioned laterally and above the working surface (4).

15. Squeegee means according to claim 13, wherein the squeegee device (10) can be pressed by means of a magnet device positioned below the working surface (4) against the latter and that pivot bearings (5) located laterally and outside the working surface (4) and having the guide faces (51) independently of one another are freely displaceably mounted in a direction a right angles to a squeegee direction and parallel to the working surface (4), the control part (8) determining and fixing the pivoting angle position and an associated pivot bearing (5) are jointly freely displaceably mounted with a bearing part (6).

16. Squeegee means according to claim 13, wherein the control part (8) is displaceably movable relative to the pivot bearing (5) in directions (V) transverse to a squeegee extension.

17. Squeegee means according to claim 1, wherein the control part (8) and the part (7) in loose engagement therewith are positioned laterally and above the working surface (4).

18. Squeegee means according to claim 17, wherein the squeegee device (10) can be pressed by means of a magnet device positioned below the working surface (4) against the latter and that pivot bearings (5) located laterally and outside the working surface (4) and having the guide faces (51) independently of one another are freely displaceably mounted in a direction a right angles to a squeegee direction and parallel to the working surface (4), the control part (8) determining and fixing the pivoting angle position and an associated pivot bearing (5) are jointly freely displaceably mounted with a bearing part (6).

19. Squeegee means according to claim 17, wherein the control part (8) is displaceably movable relative to the pivot bearing (5) in directions (V) transverse to a squeegee extension.

20. Squeegee means according to claim 1, wherein the squeegee device (10) can be pressed by means of a magnet device positioned below the working surface (4) against the latter and that pivot bearings (5) located laterally and outside the working surface (4) and having the guide faces (51) independently of one another are freely displaceably mounted in a direction at right angles to a squeegee direction and parallel to the working surface (4), the control part (8) determining and fixing the pivoting angle position and an associated pivot bearing (5) are jointly freely displaceably mounted with a bearing part (6).

21. Squeegee means according to claim 20, wherein the control part (8) is displaceably movable relative to the pivot bearing (5) in directions (V) transverse to a squeegee extension.

22. Squeegee means according to claim 1, wherein the control part (8) is displaceably movable relative to the pivot bearing (5) in directions (V) transverse to a squeegee extension.

* * * * *